US009926171B2

(12) United States Patent
Jin

(10) Patent No.: US 9,926,171 B2
(45) Date of Patent: Mar. 27, 2018

(54) EMBEDDED SAFETY ELEVATOR

(71) Applicant: Xukai Jin, Hong Kong (CN)

(72) Inventor: Xukai Jin, Hong Kong (CN)

(73) Assignee: Shenzhen Shengshi Elevator Co.,Ltd, Shenzhen, Guangdong (CN)

( * ) Notice: Subject to any disclaimer, the term of this patent is extended or adjusted under 35 U.S.C. 154(b) by 87 days.

(21) Appl. No.: 14/896,395

(22) PCT Filed: Jun. 5, 2014

(86) PCT No.: PCT/CN2014/079309
§ 371 (c)(1),
(2) Date: Mar. 21, 2016

(87) PCT Pub. No.: WO2014/194846
PCT Pub. Date: Dec. 11, 2014

(65) Prior Publication Data

US 2016/0214835 A1 Jul. 28, 2016

(30) Foreign Application Priority Data

Jun. 6, 2013 (CN) ..... 2013 1 0221810

(51) Int. Cl.
*B66B 9/02* (2006.01)
*B66B 7/02* (2006.01)
*B66B 11/04* (2006.01)

(52) U.S. Cl.
CPC ..... *B66B 9/025* (2013.01); *B66B 7/021* (2013.01); *B66B 11/0415* (2013.01); *B66B 11/0446* (2013.01)

(58) Field of Classification Search
CPC . B66B 9/025; B66B 11/0415; B66B 11/0446; B66B 7/021
See application file for complete search history.

(56) References Cited

U.S. PATENT DOCUMENTS 259,593 A * 6/1882 Sheridan et al. ..... B66B 9/025 187/271
536,215 A * 3/1895 Longauer ..... B66B 11/0415 187/262

(Continued)

FOREIGN PATENT DOCUMENTS

JP 2004182362 A * 7/2004

OTHER PUBLICATIONS

JP2004182362 English Translation.*

*Primary Examiner* — Minh Truong

(57) ABSTRACT

An embedded safety elevator includes a van body, a motor, a battery, a driving wheel, a transmission rod, an embedded elevating device, and an inwardly concave spiral guide rail. The embedded elevating device is embedded in the guide rail and can move up and down along the guide rail; the embedded elevating device is fixed on the van body to drive the van body to move up and down, the motor and the battery are mounted on the van body and are connected with the driving wheel, the driving wheel is connected with the transmission rod, and the transmission rod is further connected with the embedded elevating device. The motor is started to drive the driving wheel to rotate, the driving wheel drives the transmission rod to rotate, the transmission rod transmits the power to the embedded elevating device for driving the embedded elevating device to spirally elevate.

4 Claims, 5 Drawing Sheets

(56) References Cited

U.S. PATENT DOCUMENTS

| | | | | | |
|---|---|---|---|---|---|
| 696,994 | A * | 4/1902 | Modry | B66B 9/025 | 187/271 |
| 790,137 | A * | 5/1905 | Karrer | B66B 9/022 | 187/271 |
| 828,029 | A * | 8/1906 | Jackson | B66B 9/022 | 187/271 |
| 1,392,078 | A * | 9/1921 | Ouillett | B66B 9/02 | 187/271 |
| 1,852,134 | A * | 4/1932 | Sweet | G03B 19/18 | 74/405 |
| 3,215,227 | A * | 11/1965 | MacChesney | B66B 9/025 | 187/271 |
| 4,051,923 | A * | 10/1977 | Blanchette | B66B 5/027 | 187/271 |
| 6,655,500 | B2 * | 12/2003 | Orrman | B66B 11/008 | 187/254 |
| 2014/0182977 | A1 * | 7/2014 | Chen | B66B 9/025 | 187/271 |

* cited by examiner

EMBEDDED SAFETY ELEVATOR

CROSS REFERENCE OF RELATED APPLICATION

This is a U.S. National Stage under 35 U.S.C 371 of the International Application PCT/CN2014/079309, filed Jun. 5, 2014, which claims priority under 35 U.S.C. 119(a-d) to CN 201310221810.5, filed Jun. 6, 2013.

BACKGROUND OF THE PRESENT INVENTION

Field of Invention

The present invention relates to an embedded safety elevator, and more particularly to a spiral elevator which is capable of being embedded in the vertical track.

Description of Related Arts

Currently, there are three kinds of vertical and slope lifting elevators in the world: elevators hauled by counterweight steel wire ropes, rolling elevators and hydraulically vertical elevators. At present, elevators hauled by steel wire ropes are widely used at home and abroad, which are convenient for installation and maintenance and adapted for carrying passengers and cargoes in a building. However, elevators hauled by steel wire ropes are not adapted for currently personal residential elevators. Their main shortcomings are as follows. The hauling engine needs bearing very high torque, so that the hauling engine generally needs the power supply system with high power. However, the commonly household power supply systems are unable to load. Furthermore, during operating process, elevators hauled by steel wire ropes have a certain degree of security risk, so that there is need for regular maintenance, thereby leading to high maintenance cost.

To improve the security performance of elevators and reduce the horsepower needed by the elevator driving system, at present elevators driven by screw rods are developed, such as the spiral elevator disclosed by China Patent No. 98247710.4, which moves up and down via the spiral moving mechanism which comprises a screw thread guide rail and a screw rod pushing plate corresponding to the screw thread guide rail. An internal thread of the screw thread guide rail comprises a plurality of truckles and matches with an external thread of the screw rod pushing plate. The motor is connected with the screw rod pushing plate via a chain wheel transmission mechanism for drive the screw rod pushing plate to move up and down, so as to drive the van body of the elevator to move up and down. However, while the power is off, the brake is relieved, due to lack of the drive of the controllable power, the descent speed is not easy to be controlled, the van body of the elevator is not easy to be positioned at the normal opening position, it is difficult for passengers to normally open the door by themselves to leave the van body of the elevator. If the motor is out of operation or deadlocked, the above design is unable to have an effect. Furthermore, the above embedded safety elevator needs a very high spiral support to match the elevating height of the elevator. However, the spiral support has high manufacturing and installation cost and is not adapted for higher building elevators.

Patent No. JP2004-182362A also disclosed an elevator which adopts the spiral guide rail to move the elevator up and down. As the proximate prior art of the present invention, the Japan Patent resolves the problem that the spiral support has complicated structure and high manufacturing cost. However, compared with the present invention, Patent No. JP2004-182362A still has shortcomings as follows:

The elevator is unable to ensure the balance while operating and is easy to shake; which not only brings a certain degree of panic to passengers, but also leads to falling off of elevator parts after prolonged shaking, thereby resulting in damage of the elevator or more serious accidents.

SUMMARY OF THE PRESENT INVENTION

To resolve the problem, the present invention provides an embedded safety elevator, which has stable structure, is safe and reliable, do not occupy extra space and is convenient for installation and use.

Another object of the present invention is to provide an embedded safety elevator, which is capable of improving the operating efficiency of the elevator with triangle support and spiral rising and greatly increasing security and carrying capacity.

Another object of the present invention is to provide an embedded safety elevator, which has simple structure, is convenient for installation and operation, and is capable of greatly reducing the manufacturing cost.

Accordingly, in order to accomplish the above objects, the present invention provides a technical solution as follows.

An embedded safety elevator, comprises: a van body, a motor, a battery, a driving wheel, a transmission rod, an embedded elevating device and an inwardly concave guide rail; wherein the embedded elevating device is embedded in the inwardly concave guide rail for moving up and down along the inwardly concave guide rail; the embedded elevating device is fixed to the van body for driving the van body to move up and down; the motor and the battery are mounted on the van body and connected with the driving wheel, the driving wheel is connected with the transmission rod, the transmission rod is connected with the embedded elevating device, such that after starting the motor, the driving wheel is driven to rotate, and then the driving wheel drives the transmission rod to rotate, and then the transmission rod transmits a power to the embedded elevating device for spirally moving the embedded elevating device up and down, so as to drive the van body to move up and down.

The embedded elevating device comprises a cylindrical spiral, a transmission joint and a fixed support, wherein the cylindrical spiral has an overall cylindrical structure, an external screw thread is provided at an external surface of the cylindrical spiral, the transmission joint is fixed at an upper portion of the cylindrical spiral and engaged with the transmission rod so as to be easily driven to move up and down via the transmission rod; the fixed support is mounted on the transmission joint and fixed on the van body for allowing the embedded elevating device to drive the van body to move up and down.

The transmission joint has a frustum-shaped or worm gear-shaped structure.

There are three embedded elevating devices in the present invention, wherein one of the embedded elevating devices is located at a middle portion of a first side wall of the van body, two of the embedded elevating devices are respectively located at two corners of a second side wall opposite to the first side wall for forming a stable support to effectively balance and stabilize the van body.

The transmission rod comprises a transmission head provided at an end portion of the transmission rod and engaged with the transmission joint.

Furthermore, the transmission head has a frustum-shaped or worm gear-shaped structure.

A transmission shaft is located between the motor and the driving wheel, a clutch is located on the transmission shaft, a shaking handle is connected with the clutch, such that when the motor is out of action, the motor is disconnected with the transmission shaft via the clutch, and the van body is controlled to move up and down via the shaking handle.

The driving wheel has a frustum-shaped or worm gear-shaped structure for simultaneously driving a plurality of transmission rods to rotate.

A guide rail bracket is fixed on an external wall of the inwardly concave guide rail for directly fixing the inwardly concave guide rail to a building for facilitating mounting the guide rail.

A plurality of inwardly concave guide rails are vertically connected with each other up and down to form a track for allowing the van body to move up and down.

A cross section of the inwardly concave guide rail is semicircular; an internal screw thread, corresponding to the external screw thread which is provided at the external surface of the cylindrical spiral, is provided at an inner wall of the inwardly concave guide rail for forming an engaging structure engaging the inwardly concave guide rail with the cylindrical spiral.

Furthermore, two embedded elevating devices are respectively located at two opposite side walls or two opposite corners of the van body.

Furthermore, the van body comprises an elevating platform, a car body and a car base, wherein the elevating platform and the car base are respectively located at a top portion and a bottom portion of the car body and are respectively flexibly connected with the car body; the motor, the battery and the driving wheel are mounted on the elevating platform.

Furthermore, the elevator further comprises two suspension balancing devices and two guiding sliders, wherein the transmission rod passes through the suspension balancing device, the two suspension balancing devices are respectively mounted at positions where the elevating platform nears the two embedded elevating devices, every suspension balancing device is connected with one cylindrical spiral, every fixed support is connected with every suspension balancing device; the two guiding sliders are respectively fixed at positions where the bottom portion of the car body nears the inwardly concave guide rail, and every guide slider is located within an opening of the inwardly concave guide rail.

Furthermore, the elevator further comprises two universal transmission devices and two transmission shafts, wherein the driving wheel is a commutator, there are two transmission rods, the motor is located at a side of the commutator, the two transmission shafts are respectively located at two opposite sides of the commutator, one universal transmission device is located between one transmission shaft and one transmission rod, the two transmission rods are respectively engaged with the two embedded elevating devices.

Furthermore, a rolling object comprising steel balls is provided between the internal screw thread and the external screw thread.

The present invention adopts the inwardly concave guide rail to spirally move the elevator up and down, the inwardly concave guide rail is able to be manufactured and mounted in sections, which is convenient for producing and mounting the elevator and able to greatly reduce the manufacturing and installation cost of the elevator. Furthermore, the inwardly concave guide rail is able to directly mount on the building, do not occupy extra space, and is able to transmit the bearing capacity to the building itself for stable and reliable installation and support.

Furthermore, the cooperation of the inwardly concave guide rail and the embedded elevating device increases an engaging face therebetween to strengthen the support of spiral elevating, and stabilize the structure, so that it is difficult for the elevator to go wrong, thereby greatly improving the safety performance.

Furthermore, the present invention adopts two embedded elevating devices, which is able to act as an elevator for further reducing the manufacturing cost; and the suspension balancing devices and guiding sliders avoid the shaking while the elevator operates, so as to greatly improve the reliability and reliability.

DETAILED DESCRIPTION OF THE PREFERRED EMBODIMENT

To more clearly understand objects, technical solutions and advantages, the present invention is further described in detail accompanying with drawings and embodiments.

Figure 1:
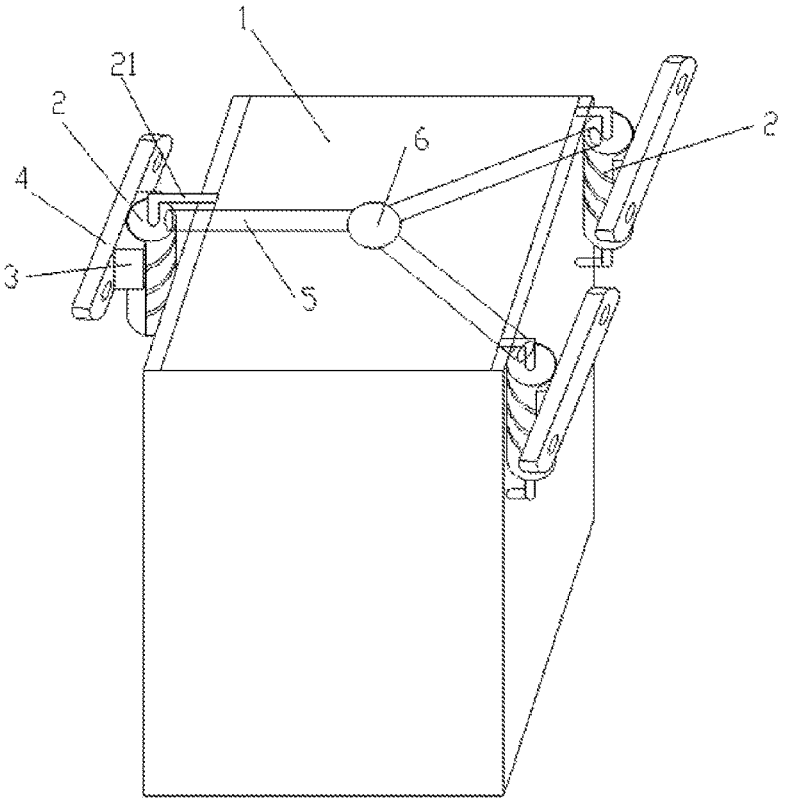
FIG. 1 is a structurally schematic view of the present invention.
Figure 2:
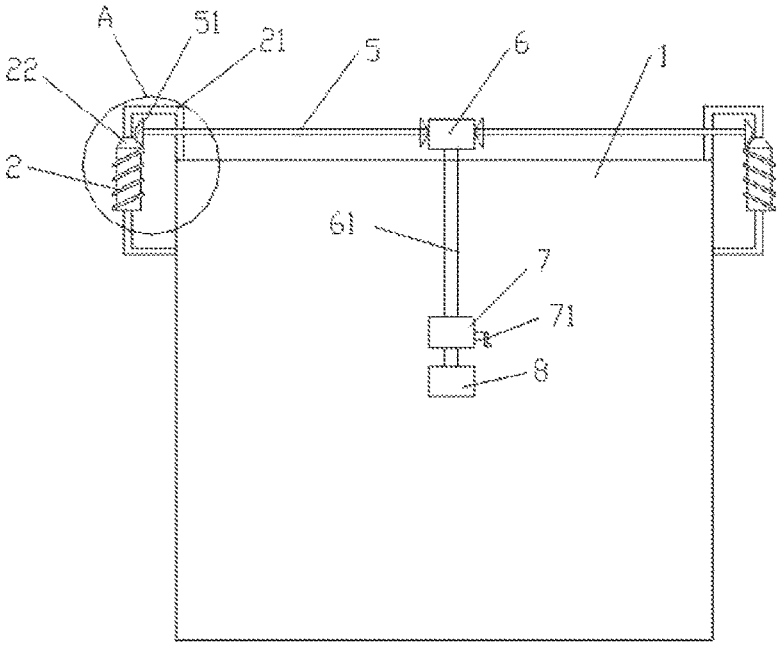
FIG. 2 is a front view of the present invention.

Referring to FIGS. 1 and 2 of the drawings, an embedded safety elevator according to a preferred embodiment of the present invention is illustrated, comprising a van body 1, a motor 8, a battery (not shown in drawings), a driving wheel 6, a transmission rod 5, an embedded elevating device 2 and an inwardly concave guide rail 3; wherein the embedded elevating device 2 is fixed to the van body 1 by a fixed support 21 and embedded in the inwardly concave guide rail 3, such that the embedded elevating device 2 is capable of moving up and down along the inwardly concave guide rail 3 to drive the van body to move up and down.

The motor 8 and the battery are mounted on the van body (in generally, in order not to affect the use of the van body, the motor 8 is mounted at a bottom of the van body 1) and is connected with the driving wheel 6, a transmission shaft 61 is located between the motor 8 and the driving wheel 6, a clutch 7 is located on the transmission shaft 61, a shaking handle 71 is connected with the clutch 7. When the motor is out of action, the motor 8 is disconnected with the transmission shaft 61 via the clutch 7, and then the van body 1 is controlled to move up and down via the shaking handle 71, so as to safely move the elevator up and down. The battery is connected with the motor 8 and is adapted to supply a power for the motor 8.

Figure 3:
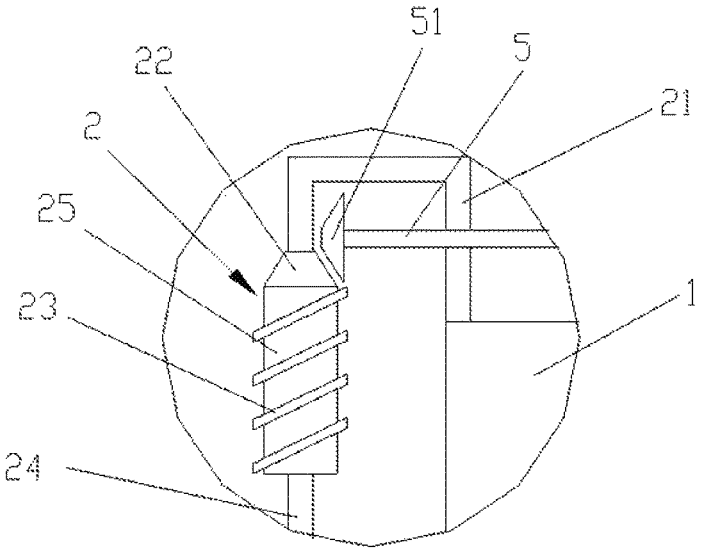
FIG. 3 is a partially enlarged view of section A in FIG. 2.

The driving wheel 6 is connected with the transmission rod 5. The transmission rod 5 comprises a transmission head 51, as shown in FIG. 3, wherein the transmission head 51, having a frustum-shape, is provided at an end portion of the transmission rod 5 and engaged with a frustum-shaped transmission joint 22 of the embedded elevating device 2, in such a manner that after starting the motor 8, the driving wheel 6 is driven by the transmission shaft 61 to rotate, and then the driving wheel 6 drives the transmission rod 5 to rotate, and then the transmission rod 5 transmits a power to the embedded elevating device 2 for spirally moving the embedded elevating device 2 up and down, so as to drive the van body 1 to move up and down.

The driving wheel 6 has a frustum-shaped or worm gear-shaped structure for simultaneously driving a plurality of transmission rods 5 to rotate.

Referring to FIG. 3 again, the embedded elevating device 2 comprises a cylindrical spiral 25, the frustum-shaped transmission joint 22 and the fixed support 21, wherein the cylindrical spiral 25 has an overall cylindrical structure, an external screw thread 23 is provided at an external surface of the cylindrical spiral 25, the frustum-shaped transmission joint 22 is fixed at an upper portion of the cylindrical spiral 25 and engaged with the transmission head 51 so as to be easily driven to move up and down via the transmission rod 5.

The fixed support 21 is mounted on the frustum-shaped transmission joint 22 and fixed on the van body 1.

Figure 4:
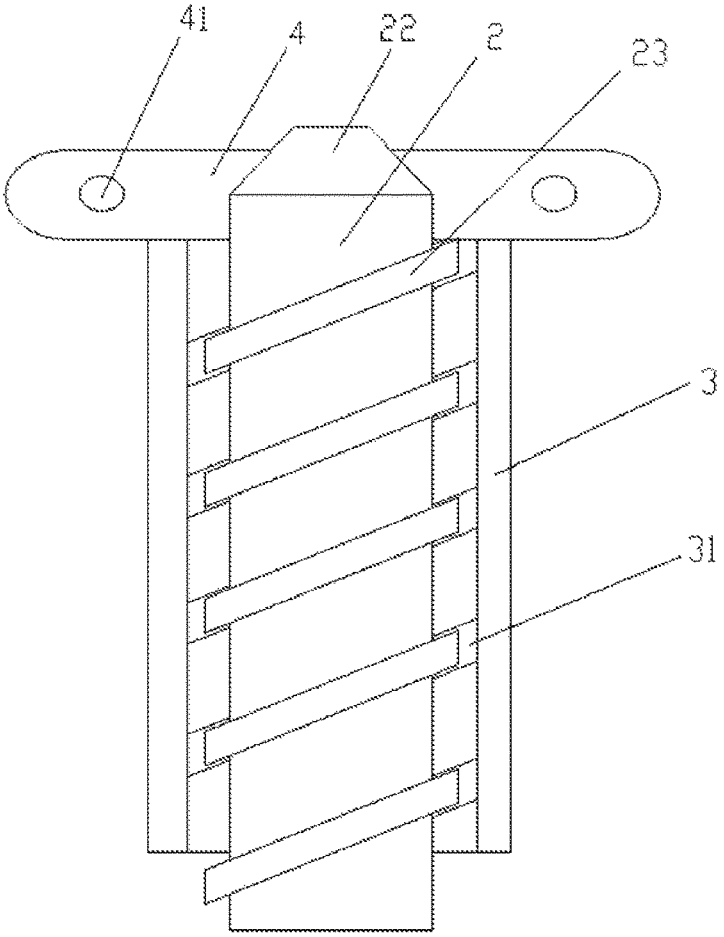
FIG. 4 is a front view which shows an inwardly concave guide rail cooperating with an embedded elevating device.
Figure 5:
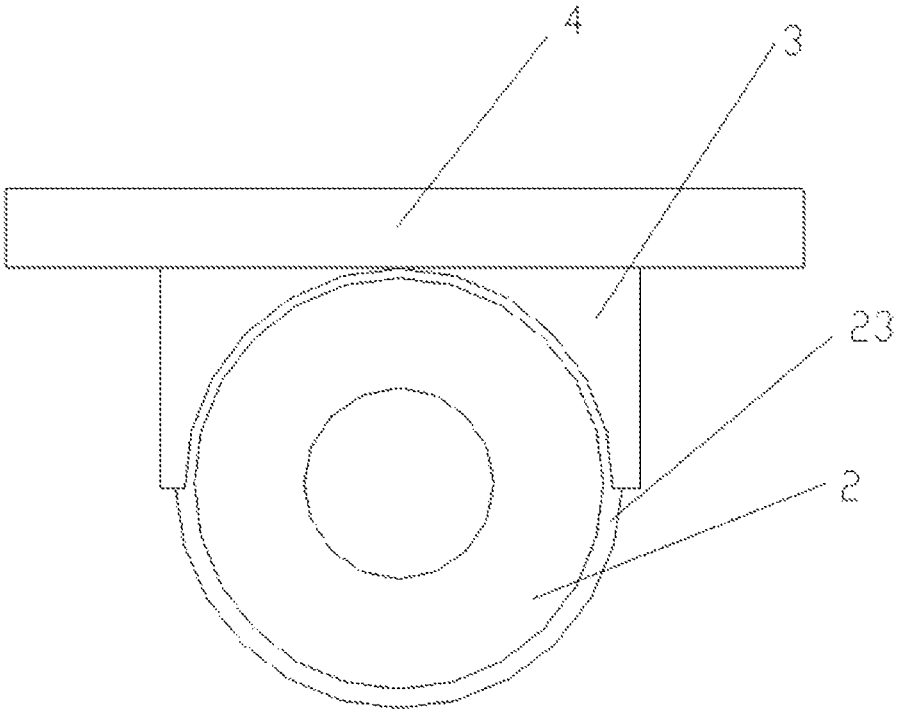
FIG. 5 is a top view which shows the inwardly concave guide rail cooperating with the embedded elevating device.

Referring to FIGS. 4 and 5, a guide rail bracket 4 is fixed on an external wall of the inwardly concave guide rail 3 for directly fixing the inwardly concave guide rail 3 to a building. Generally, a plurality of inwardly concave guide rails 3 are located at an exterior of an elevator and vertically connected with each other up and down to form a track for allowing the van body to move up and down.

A cross section of the inwardly concave guide rail 3 is semicircular. An internal screw thread 31, corresponding to the external screw thread 23 which is provided at the external surface of the cylindrical spiral, is provided at an inner wall of the inwardly concave guide rail 3 for forming an engaging structure engaging the inwardly concave guide rail 3 with the cylindrical spiral, in such a manner that an engaging face of the external screw thread 23 of the cylindrical spiral 25 and the internal screw thread 31 of the inwardly concave guide rail 3 is greatly increased to strengthen the support of embedded elevating, and stabilize the structure, so that it is difficult for the elevator to go wrong, thereby greatly improving the safety performance.

Referring to FIGS. 1 and 2 again, in general, three embedded elevating devices 2 are mounted on the van body 1, wherein one of the embedded elevating devices 2 is located at a middle portion of a first side wall of the van body, two of the embedded elevating devices 2 are respectively located at two corners of a second side wall opposite to the first side wall for forming a stable support via three different corners to effectively balance and stabilize the van body.

While normally moving the elevator up and down, the motor 8 drives the driving wheel 6 to rotate via the transmission shaft 61, and then the driving wheel 6 drives the transmission rod 5 to rotate, and then the transmission rod 5 transmits the power to the embedded elevating device 2, the embedded elevating device 2 moves up and down in the inwardly concave guide rail 3 for allowing the van body 1 to move up and down.

If the motor 8 goes wrong, the motor 8 is disconnected with the transmission shaft 61 via the clutch 7, and then the transmission shaft 61 is directly controlled by the shaking handle 71, so as to safely move up and down.

It is worth to mention that in order to facilitate installation, a retractable mechanism is generally mounted on the transmission rod 5 for adjusting a length of the transmission rod 5 to fitly match the transmission rod 5 with the embedded elevating device 2.

An embedded safety elevator according to another embodiment of the present invention is illustrated, which has similar structure with the embedded safety elevator according to the above mentioned embodiment. Main differences are as follows.

Figure 6:
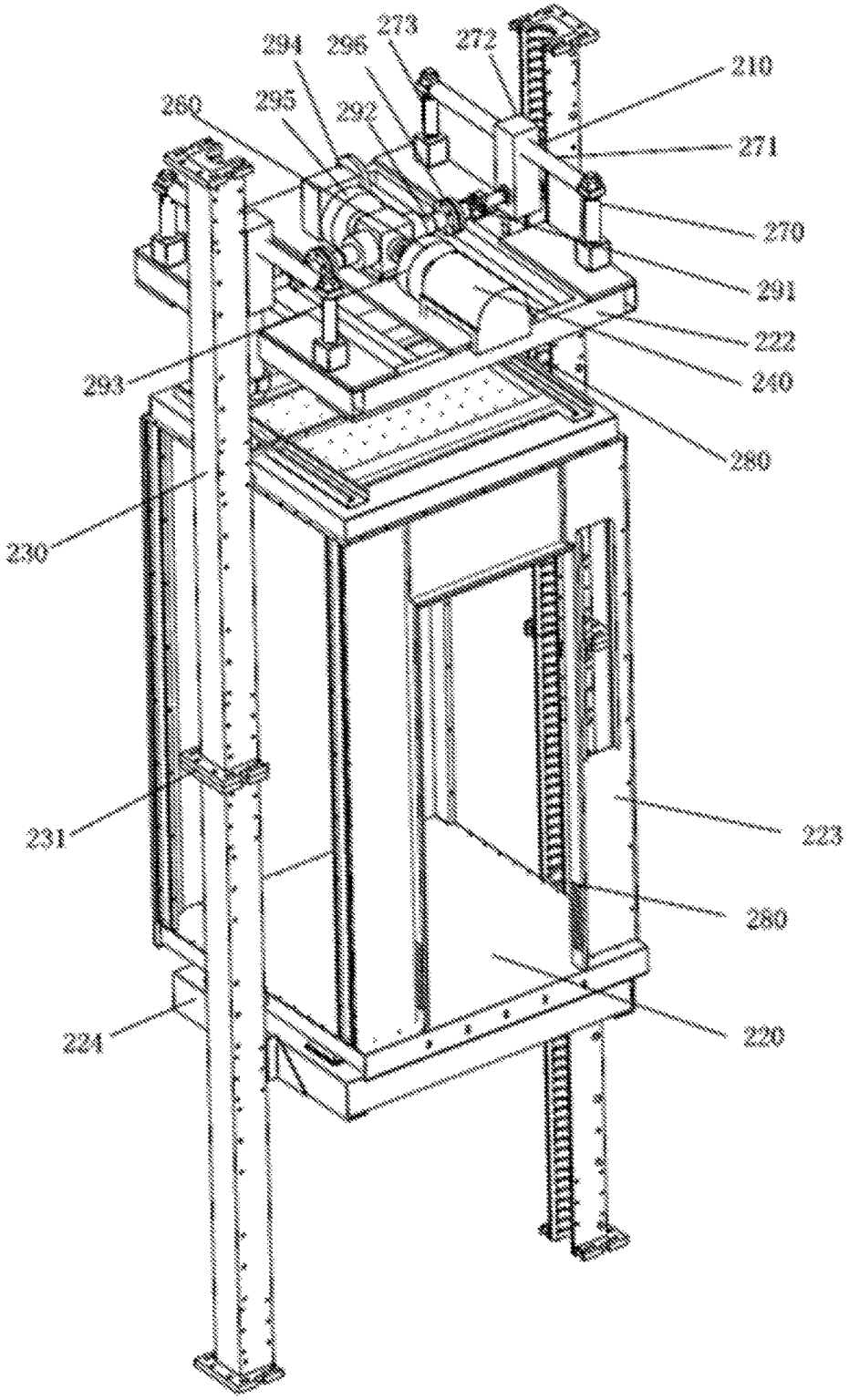
FIG. 6 is a structurally schematic view of another embodiment of the present invention.
Figure 7:
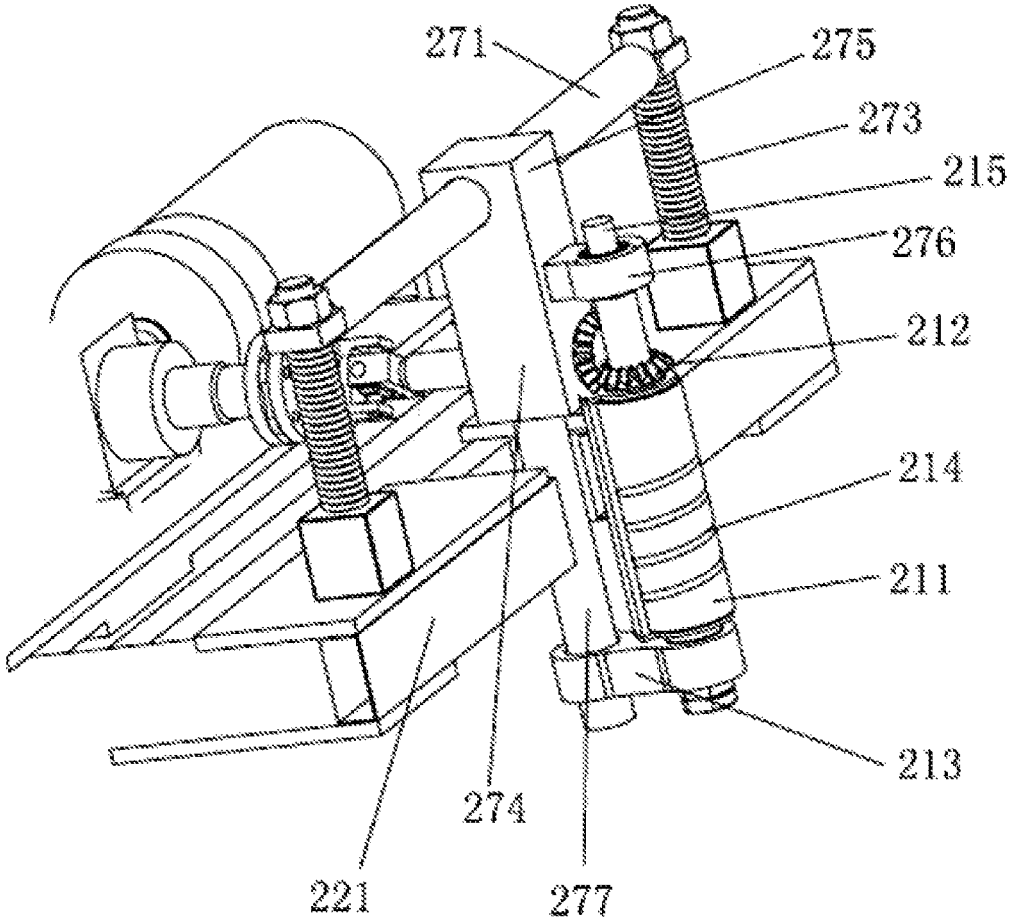
FIG. 7 is a side view which shows the embedded elevating devices cooperating with the suspension balancing devices in FIG. 6.

Referring to FIGS. 6 and 7, the embedded safety elevator of the present invention comprises two embedded elevating devices 210 respectively located at two opposite side walls or two opposite corners of the van body 220. Accordingly, there are two inwardly concave spiral guide rails 230, every inwardly concave spiral guide rail 230 is spirally connected with every embedded elevating device 210. Every embedded elevating device 210 comprises a cylindrical spiral 211, a transmission joint 212 and a fixed support 213, wherein the cylindrical spiral 211 has an overall cylindrical structure, an external screw thread 214 is provided at an external surface of the cylindrical spiral 211, the transmission joint 212 is fixed at an upper portion of the cylindrical spiral 211 and engaged with a transmission rod (not shown in drawings). The cylindrical spiral 211 is mounted on the van body 220 via the fixed support 213. A cross section of the inwardly concave spiral guide rail 230 is semicircular. An internal screw thread (not shown), corresponding to an external screw thread 214 which is provided at an external surface of the cylindrical spiral 211, is provided at an inner wall of the inwardly concave spiral guide rail 230. A rolling object such as steel balls or steel pole is located between the internal screw thread and the external screw thread 214. The elevator further comprises a guide rail bracket 231 fixedly connected with an external wall of the inwardly concave spiral guide rail 230. The inwardly concave spiral guide rail 230 is fixed on a construction wall where the elevator is mounted via the guide rail bracket 231. A plurality of inwardly concave spiral guide rails 230 are sequentially connected with each other.

The van body 220 comprises an elevating platform 221, a car body 222 and a car base 223, wherein the elevating platform 221 and the car base 223 are respectively located at a top portion and a bottom portion of the car body 222 and are respectively flexibly connected with the car body 222. The elevator comprises a motor 240, a battery (not shown) and a driving wheel 260, wherein the motor 240, the battery and the driving wheel 260 are mounted on the elevating platform 221. The battery is connected with the motor 240 and adapted to supply a power for the motor 240. According to the actually operational need, the battery is connected with the motor 240 via a connecting wire. The battery is able to be located at different positions of the van body 220, namely, the battery is able to be located at different positions of the elevating platform 221, the car body 222 or the car base 223 of the van body 220.

The elevator further comprises two suspension balancing devices 270 and two guiding sliders 280, wherein the transmission rod passes through the suspension balancing device 270, the two suspension balancing devices 270 are respectively mounted at positions where the elevating platform 221 nears the two embedded elevating devices 210, every suspension balancing device 270 is connected with one cylindrical spiral 211, every fixed support 213 is connected with every suspension balancing device 270. A fixed joint 215 is located at a top of every cylindrical spiral 211, the fixed joint 215 is located at the top of a rod body (not shown) of the cylindrical spiral 211 which passes through the transmission joint 212 and is adapted for fixedly connecting with the suspension balancing device 270. Every suspension balancing device 270 comprises a balancing rod 271, a bearing seat 272 and two suspension units 273. The two suspension units 273 respectively pass through two ends of the balancing rod 271 for mounting the balancing rod 271 on the elevating platform 221. The suspension units 273 are flexibly connected with a top of the elevating platform 221 to flexibly connect the balancing rod 271 with the elevating platform 221. The bearing seat 272 comprises a lateral opening 274, a longitudinal opening 275, a connecting lantern ring 276 and a connecting rod 277, wherein the connecting rod 277 is located at a bottom of the bearing seat 272, the longitudinal opening 275 is located at a top of the bearing seat 272, the lateral opening 274 is located between the longitudinal opening 275 and the connecting rod 277, the connecting lantern ring 276 is located between the lateral opening 274 and the longitudinal opening 275 and extends outwardly. The transmission rod passes through the lateral opening 274. The balancing rod 271 passes through the longitudinal opening 275. A bottom of the connecting rod 277 is connected with one end of the fixed support 213, and the other end of the fixed support 213 is connected with a bottom of the cylindrical spiral 211 for connecting the cylindrical spiral 211 with the suspension balancing device 270. The connecting lantern ring 276 is adapted for sleevedly mounting to the fixed joint 215 of the cylindrical spiral 211 to fixedly connect the bearing seat 272 with the embedded elevating devices 210. It can be seen, from the above description, that the bearing seat 272 is fixedly connected with the embedded elevating devices 210, the balancing rod 271 passes through the longitudinal opening of the bearing seat 272 to flexibly connect with the elevating platform 221, such that the balancing rod 271 is able to maintain a balancing stable connection between the embedded elevating devices 210 and the van body 220, so as to avoid the shaking of the van body 220.

The two guiding sliders 280 are respectively fixed at positions where a bottom portion of the car body 222 nears the inwardly concave spiral guide rail 230, and every guide slider 280 is located within an opening of the inwardly concave spiral guide rail 230, so as to maintain a stability of the van body 220 while the embedded elevating devices 210 drive the van body 220 to move up and down relatively to the inwardly concave spiral guide rail 230. According to actual requirements, the elevator further comprises two guiding sliders 280 respectively located at a top portion of the car body 222 and also closed to the inwardly concave spiral guide rail 230. Moreover, according to actually operational requirements, a shedding device is located at an exterior of a side wall of the inwardly concave spiral guide rail 230, every guiding slider 280 is located within the shedding device and cooperates with the shedding device for moving up and down within the shedding device. The shedding device is able to be a linear slide track located at the exterior of the side wall of the inwardly concave spiral guide rail.

The elevator further comprises two universal transmission devices 291 and two transmission shafts 292, wherein the driving wheel is a commutator (not shown), there are two transmission rods, the motor 240 is located at a side of the commutator, the two transmission shafts 292 are respectively located at two opposite sides of the commutator, every universal transmission device 291 is located between one transmission shaft 292 and one transmission rod, the two transmission rods are respectively engaged with the two embedded elevating devices 210. The transmission shafts 292 transmit a torque outputted by the commutator to the universal transmission devices 291, and the universal transmission devices 291 transmit the torque outputted by the transmission shafts 292 to the transmission rods, and then the transmission rods transmit the torque to the embedded elevating devices 210.

A first clutch 293 is located between the motor 240 and the commutator for transmitting a torque of the motor to the commutator, or disconnecting the motor 240 with the commutator. A worm reduction gear 294 is located at a position where the commutator faces against the motor for controlling the torque outputted by the commutator for controlling a speed change of the two transmission shafts 292. A second clutch 295 is located between the worm reduction gear 294 and the commutator and adapted for controlling a connection or disconnection between the worm reduction gear 294 and the commutator. A shaft coupling 296 is located on every transmission shaft 292 for transmitting the torque outputted by the commutator to the universal transmission devices 291.

One skilled in the art will understand that the embodiment of the present invention as shown in the drawings and described above is exemplary only and not intended to be limiting. This invention includes all modifications, equivalent replacements and improvements encompassed within the spirit and scope of the following claims.

What is claimed is:

1. An embedded safety elevator, comprising: a van body, a motor, a driving wheel, a transmission rod, an embedded elevating device and an inwardly concave spiral guide rail; wherein:

the embedded elevating device is embedded in the inwardly concave spiral guide rail for moving up and down along the inwardly concave guide rail; the embedded elevating device is fixed to the van body for driving the van body to move up and down; the motor is mounted on the van body and connected with the driving wheel, the driving wheel is connected with the transmission rod, the transmission rod is connected with the embedded elevating device;

the embedded elevating device comprises a cylindrical spiral, a transmission joint and a fixed support, wherein the cylindrical spiral has an overall cylindrical structure, an external screw thread is provided at an external surface of the cylindrical spiral, the transmission joint is fixed at an upper portion of the cylindrical spiral and engaged with the transmission rod, wherein the cylindrical spiral is fixed on the van body via the fixed support;

there are three embedded elevating devices, one of the embedded elevating devices is located at a middle portion of a first side wall of the van body, two of the embedded elevating devices are respectively located at two corners of a second side wall opposite to the first side wall;

a cross section of the inwardly concave spiral guide rail is semicircular; an internal screw thread, corresponding to the external screw thread which is provided at the external surface of the cylindrical spiral, is provided at an inner wall of the inwardly concave spiral guide rail; wherein the elevator further comprises a guide rail bracket fixedly connected with an external wall of the inwardly concave spiral guide rail; there are a plurality of inwardly concave spiral guide rails sequentially connected with each other.

2. The embedded safety elevator, as recited in claim 1, wherein the transmission rod comprises a transmission head provided at an end portion of the transmission rod and engaged with the transmission joint; the driving wheel has a frustum-shaped or worm gear-shaped structure.

3. The embedded safety elevator, as recited in claim 2, wherein a transmission shaft is located between the motor and the driving wheel, a clutch is located on the transmission shaft, a shaking handle is connected with the clutch.

4. The embedded safety elevator, as recited in claim 1, wherein a transmission shaft is located between the motor and the driving wheel, a clutch is located on the transmission shaft, a shaking handle is connected with the clutch.

* * * * *